US008352318B2

(12) United States Patent
Rikhtverchik et al.

(10) Patent No.: US 8,352,318 B2
(45) Date of Patent: Jan. 8, 2013

(54) EXCLUSIVITY IN INTERNET MARKETING CAMPAIGNS SYSTEM AND METHOD

(75) Inventors: Sonya Rikhtverchik, Mountain View, CA (US); Oliver Chang, Cleveland Heights, OH (US)

(73) Assignee: Digital River, Inc., Eden Prairie, MN (US)

( * ) Notice: Subject to any disclaimer, the term of this patent is extended or adjusted under 35 U.S.C. 154(b) by 765 days.

(21) Appl. No.: 12/129,480

(22) Filed: May 29, 2008

(65) Prior Publication Data

US 2008/0300909 A1 Dec. 4, 2008

Related U.S. Application Data

(60) Provisional application No. 60/940,568, filed on May 29, 2007.

(51) Int. Cl.
*G06Q 30/00* (2012.01)

(52) U.S. Cl. ..... 705/14.41; 705/14.42; 705/7.29; 707/694; 707/610; 702/186; 709/218

(58) Field of Classification Search ..... None
See application file for complete search history.

(56) References Cited

U.S. PATENT DOCUMENTS

| | | | | |
|---|---|---|---|---|
| 6,006,197 | A | 12/1999 | d'Eon et al. | |
| 6,236,977 | B1 | 5/2001 | Verba et al. | |
| 6,393,479 | B1 | 5/2002 | Glommen et al. | |
| 6,539,392 | B1 * | 3/2003 | Rebane | 705/10 |
| 6,970,830 | B1 | 11/2005 | Samra et al. | |
| 7,050,989 | B1 | 5/2006 | Hurt et al. | |
| 7,085,682 | B1 * | 8/2006 | Heller et al. | 702/186 |
| 7,299,457 | B2 | 11/2007 | Marshall | |
| 7,349,827 | B1 * | 3/2008 | Heller et al. | 702/186 |
| 7,441,195 | B2 * | 10/2008 | Error et al. | 715/738 |
| 7,752,308 | B2 * | 7/2010 | Hutchinson | 709/224 |
| 7,792,843 | B2 * | 9/2010 | Iverson | 707/751 |
| 2002/0072954 | A1 * | 6/2002 | Sales | 705/10 |
| 2002/0087679 | A1 * | 7/2002 | Pulley et al. | 709/224 |
| 2003/0115586 | A1 * | 6/2003 | Lejouan et al. | 725/9 |
| 2004/0054784 | A1 | 3/2004 | Busch et al. | |
| 2004/0093296 | A1 * | 5/2004 | Phelan et al. | 705/36 |
| 2006/0277212 | A1 * | 12/2006 | Error | 707/102 |
| 2006/0277585 | A1 | 12/2006 | Error et al. | |
| 2007/0011304 | A1 | 1/2007 | Error | |
| 2007/0143343 | A1 * | 6/2007 | Iverson | 707/104.1 |

(Continued)

OTHER PUBLICATIONS

"Current Trends in Web Data Analysis" Arun Sen, P. Dacin, and C. Pattichis Communications of the ACM; Nov. 2006 vol. 49, No. 11.*

(Continued)

*Primary Examiner* — Gurkanwaljit Singh
(74) *Attorney, Agent, or Firm* — Clise, Billion & Cyr, P.A.; Richard E. Billion

(57) ABSTRACT

A marketing campaign collects data for page counts, sessions, orders, and revenue. Four kinds of campaigns are addressed: direct, deferred, site link tracking, and deferred site link tracking. A particular page visit in an end-user session "qualifies" for a campaign if it satisfies the configured conditions for the campaign; that is, if the target universal resource locator (URL) of the page is the landing page of the campaign, the referrer URL is the referrer page of the campaign, or the page tag contains the configured string for the campaign. The data is processed through a set of heuristics identified by marketing experts as the most likely paths to a sale, and exclusivity is assigned to the type of campaign with the highest priority.

24 Claims, 6 Drawing Sheets

U.S. PATENT DOCUMENTS

2008/0097849 A1* 4/2008 Ramsaier et al. ..... 705/14

OTHER PUBLICATIONS

"Taking the measure of e-marketing success" Scott Cotter, The Journal of Business Strategy; Mar./Apr. 2002; 23, 2; ABI/INFORM Global p. 30.*

Srivastava, P. Desikan, and V. Kumar, "Web Mining: Accomplishments and Future Directions," Proc. US Nat'l Science Foundation Workshop on Next-Generation Data Mining (NGDM), Nat'l Science Foundation, 2002.*

"Taking the measure of e-marketing success" Scott Cotter; The Journal of Business Strategy; Mar./Apr. 2002; 23, 2.*

"Current Trends in Web Data Analysis" Sen, Arun et al., Communications of the ACM Nov. 2006/vol. 49, No. 11.*

* cited by examiner

200

| 2 Report Type | 3 Target | 4 Referrer | 5 Link | 6 Session Id | 7 Session Count | 8 Page Title | 9 Load Time | 10 View Time | 11 Embedded | 12 Cookie | 13 HS Response Time |
|---|---|---|---|---|---|---|---|---|---|---|---|
| $2 | $3 | $4 | $5 | $6 | $7 | $8 | $9 | $10 | $11 | $12 | $13 |

| 14 Prefetched Elements | 15 Elements in Hints | 16 Hint Already Seen | 17 Viewed for 1st time Prefetched | 18 Viewed 1st time not Prefetched | 19 - | 20 Conx Speed | 21 Conx Type | 22 Prev Conx Speed | 23 Visits to Order | 24 Days to Order | 25 Visit Freq |
|---|---|---|---|---|---|---|---|---|---|---|---|
| $14 | $15 | $16 | $17 | $18 | $19 | $20 | $21 | $22 | $23 | $24 | $25 |

| 26 Purchase Freq | 27 Vis Chip | 28 - | 29 Time in Session | 30 Preprod Rules | 31 Seconds since last page | 32 Screen Resolution | 33 Color Depth | 34 Cookies Enabled | 35 Referring URL | 36 Product 1st Visit | 37 Flash Version |
|---|---|---|---|---|---|---|---|---|---|---|---|
| $26 | $27 | | $29 | $30 | $31 | $32 | $33 | $34 | $35 | $36 | $37* |

202

FIG. 2

| 1 User Agent | 2 Remote IP | 3 Serial | 4 Target Matches | 5 Normalized Target | 6 Third- Party Cookie Enabled |
|---|---|---|---|---|---|
| $37* | $38 | $39 | $40 | $41 | $42* |

500

| 1 Geo Metro Code | 2 Geo Country Code | 3 Campaigns | 4 Campaign IDs | 5 Browser | 6 Version | 7 OS |
|---|---|---|---|---|---|---|
| $42* | $43 | $44 | $45 | $46 | $47 | $48 |

| 8 Geo Region | 9 Geo City | 10 Campaign Exclusivity Order | 11 Site Link Exclusivity Order | 12 Internal Search Exclusivity Order |
|---|---|---|---|---|
| $49 | $50 | $51 | $51 | $51 |

FIG. 5

700

710 702 704 706 708

Display All Campaigns | Display My Campaigns

Marketing Campaign Summary - Month starting March 1, 2005

EXPORT PRINT HELP INDEX SETUP REPORT BUILDER

Marketing Campaigns ▸ keyword ▸ Overture

Page 1 of 3 Sort By Filter APPLY RESET

| | Page Views | Sessions | Orders | Revenue ($) | % Rate | Cost | ROI |
|---|---|---|---|---|---|---|---|
| apparel close-outs | 276,497 | 207,701 | 248 | 20,828 | 0.12 | 0 | N/A |
| bag accessories | 52,186 | 36,338 | 124 | 4,957 | 0.34 | 0 | N/A |
| belts {1 wallets | 56,215 | 43,072 | 0 | 0 | 0 | 0 | N/A |
| ben hogan | 20,879 | 7,748 | 66 | 6,929 | 0.85 | 0 | N/A |
| books | 124 | 124 | 0 | 0 | 0 | 0 | N/A |
| books {1 videos | 5,332 | 5,332 | 0 | 0 | 0 | 0 | N/A |
| callaway golf | 314,371 | 179,591 | 158 | 27,567 | 0.09 | 0 | N/A |
| carts accessories | 372 | 372 | 0 | 0 | 0 | 0 | N/A |
| carts {1 accessories | 58,834 | 51,992 | 0 | 0 | 0 | 0 | N/A |
| close outs | 248 | 248 | 0 | 0 | 0 | 0 | N/A |
| club accessories | 60,603 | 52,055 | 0 | 0 | 0 | 0 | N/A |
| collectibles | 5,704 | 5,580 | 0 | 0 | 0 | 0 | N/A |
| complete sets | 762,668 | 532,271 | 67 | 8,039 | 0.01 | 0 | N/A |
| divot tools/tees | 44,507 | 36,276 | 0 | 0 | 0 | 0 | N/A |
| drivers | 3,950,408 | 2,523,847 | 778 | 183,762 | 0.03 | 0 | N/A |
| fairway woods | 1,980,080 | 1,348,322 | 777 | 162,698 | 0.06 | 0 | N/A |
| gift cards | 7,192 | 5,971 | 0 | 0 | 0 | 0 | N/A |
| gift ideas | 18,340 | 18,010 | 0 | 0 | 0 | 0 | N/A |
| gloves | 413,409 | 263,510 | 124 | 2,106 | 0.05 | 0 | N/A |
| golf bags | 586,172 | 416,858 | 0 | 0 | 0 | 0 | N/A |
| golf balls | 703,556 | 462,612 | 560 | 45,407 | 0.12 | 0 | N/A |

FIG. 7

EXCLUSIVITY IN INTERNET MARKETING CAMPAIGNS SYSTEM AND METHOD

This application claims the benefit of U.S. Provisional Application No. 60/940,568 filed 29 May 2007, entitled "Exclusivity In Campaigns To Match Order To Campaign," which is incorporated herein by reference.

FIELD OF THE INVENTION

The present invention relates to web page statistical reporting. In particular, it relates to data gathering and reporting techniques for web-based marketing campaigns.

BACKGROUND OF THE INVENTION

The World Wide Web (web) has rapidly become an invaluable tool to individuals and businesses. Not only can an individual or business post information on the web, but it can also use the web to transact business. Because the public is acutely aware of the web's business and personal benefits, millions of web pages are being added to the web each year.

Typically, a web page is defined by a document containing Hyper Text Markup Language (HTML) code. An HTML document suitable for posting on the internet includes both "content" and "markup." The content is information which describes a web page's text or other information for display or playback on a computer's monitor, speakers, etc. The markup is information which describes the web page's behavioral characteristics, such as how the content is displayed and how other information can be accessed via the web page.

In order to provide web-based information and services over the internet, the web employs "client" computers, "browser" software, and "server" computers. A client computer is a computer used by an individual to connect to the internet and access web pages. A browser is a software application, located on a client computer, which requests, via the internet, a web page from a server computer. After receiving the web page, the browser displays the web page on the client computer's monitor. A server computer is a computer which stores web page information, retrieves that information in response to a browser's request, and sends the information, via the internet, to the client computer. Thus, after a web page is created, the page should be "posted" to a particular server computer which "hosts" the page, so that the page can be accessed over the internet.

One web-based service that has seen steady growth in the past decade is e-commerce. The percentage of sales made over the internet continues to grow by double-digits annually. With an adjusted retail sales value of over $36 billion dollars in the fourth quarter of 2007, the percentage of retail sales conducted over the internet increased nearly 5% over the same period the previous year, and accounted for 3.5% of total retail sales in 2007.

With this kind of opportunity for online sales, web merchants are anxious to learn how to leverage the benefits of e-commerce to maximize their own sales. Carefully planned and executed marketing campaigns allow e-commerce merchants to increase sales and return on investment. E-mail marketing, search engine advertising (keyword management) and affiliate marketing are just some types of popular marketing campaigns. Whatever type of campaign chosen, the key to a successful campaign is determining what brought the customer, or end-user, to the point of purchase.

Web analytics is focused on analyzing and understanding buyer behavior, expanding a customer base and increasing customer loyalty. When web analytics are applied to marketing campaigns, merchants may discover which campaign or campaign feature brought the customer to the point of purchase. However, a merchant may run concurrent campaigns, or use campaign features, such as site link tracking or natural search which may make it difficult to understand the path that led the customer to the final point of purchase. A need exists to provide merchants with a clearer indication of which campaign actually resulted in a sale.

The present invention provides a solution to these needs and other problems, and offers other advantages over the prior art.

BRIEF SUMMARY OF THE INVENTION

The present invention is related to a software system that solves the above-mentioned problems. A web analytics system and method for a marketing campaign collects data for page counts, sessions, orders, and revenue. A particular page visit in an end-user session "qualifies" for a campaign if it satisfies the configured conditions for the campaign; that is, for example, if the target URL of the page is the landing page of the campaign, if the referrer URL is the referrer page of the campaign, or if the page tag contains the configured string for the campaign. While these three filters are used as exemplary qualifiers it will be appreciated by those skilled in the art that other filters may be utilized without departing from the scope and spirit of the present invention.

When a merchant creates a campaign and a particular end-user's session qualifies for more than one of them (e.g. he visits a page that matches the landing pages of two different campaigns), the session plus any orders could be counted towards all of the matching campaigns. This situation is less than ideal for a merchant, because the totals for orders and revenue of all the campaigns will appear to be over-counted (i.e., some sessions may be counted twice). A feature of the present invention as described herein addresses this over-counting by allowing marketing campaigns or site link tracking campaigns to be exclusive. As will be described in more detail below, orders and revenue will be counted towards at most one campaign. Sessions may be counted towards all matching campaigns.

Additional advantages and features of the invention will be set forth in part in the description which follows, and in part, will become apparent to those skilled in the art upon examination of the following or may be learned by practice of the invention.

BRIEF DESCRIPTION OF THE DRAWINGS

FIG. 2. is an exemplary report message structure for a client message.

FIG. 5 is an exemplary report message structure for the elements added by a preferred embodiment prediction engine.

FIG. 7 is a screen shot of a marketing campaign report in accordance with one embodiment of the invention.

DETAILED DESCRIPTION

Commonly Used Terms

Figure 1:
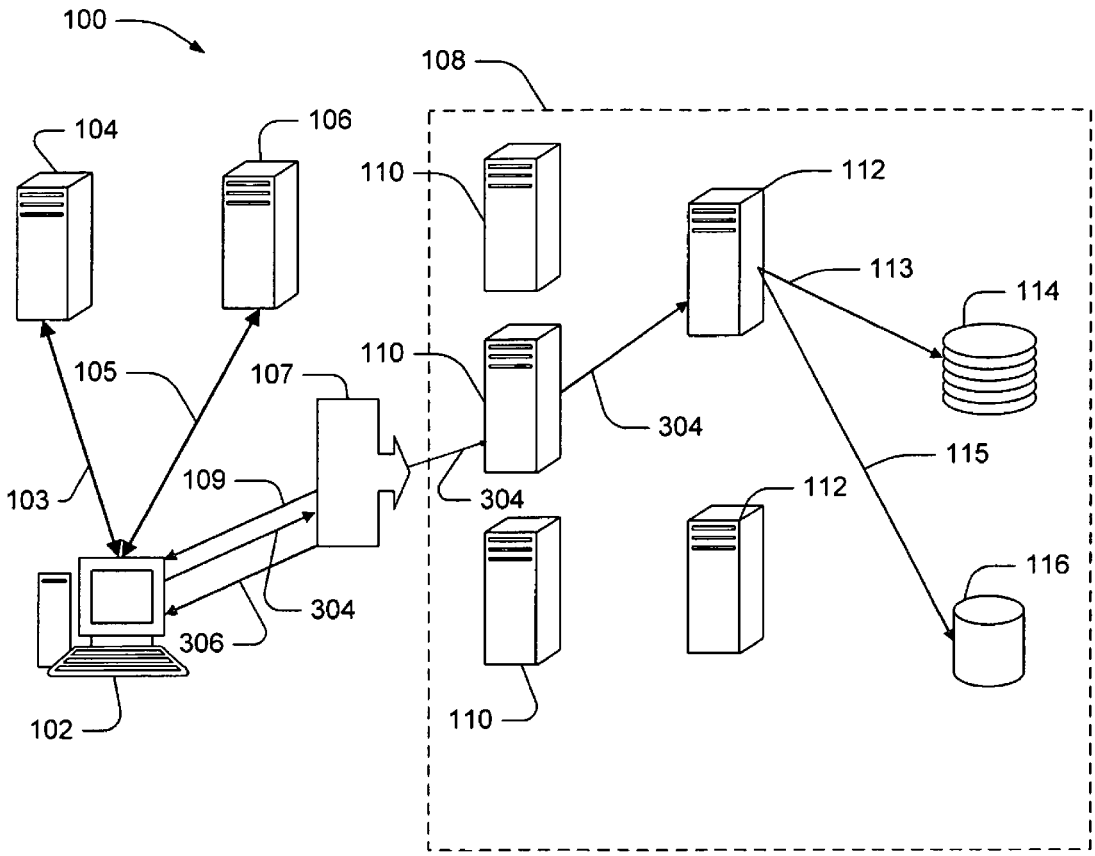
FIG. 1 is a diagram of a web analytics system designed to collect and report web analytics for online marketing campaigns.

The following terms are commonly used in the web analytics field, or have developed a specific meaning within this technology area of practice. These definitions are meant to be illustrative only and may help provide context to and understanding of the system and method as described below.

Accumulator: a data storage component or class of the prediction engine which performs aggregation of historical data collected from report messages.

Big script: a set of JavaScript code downloaded to the client computer for use in a tracking session. These scripts may be system or browser specific. The scripts are designed to collect data and send a report message to the hint servers.

Campaign: a tracking object with one or more "filters" that yield several metrics.

Chip: a matched filter identifier.

Client-Side: The client system and the scripts downloaded to it for data collection.

Deferred campaigns: campaigns that track users that matched a direct campaign first and then came back to the website any time between original match and deferred expiration period (e.g., this could be set as a default to a 7 day period).

Direct campaign: campaigns that track users matching a certain filter.

Exclusivity: a way to tell which campaign "gets credit" for an order.

Filters: parameters of a campaign, such as landing page, referrer, or page tags.

Hint server: stateless server that matches patterns and serves predictions to client side and forwards report messages to the prediction engine.

Internal search: a project that tracks search queries used on merchant websites.

Match: a result of comparing an incoming data stream to patterns such as campaign information. A user session matches a campaign when there is a match to all filters associated with a campaign. For direct campaigns that means that all (one or more) patterns in landing or referring URLs or in a page tag are matched in a session. For deferred campaigns that means that a match can be made to a direct campaign that matched in a previous session within the expiration period.

Merchant: the merchant or website administrator of an online store.

Natural search: an object that tracks unpaid keywords from search engines that led to merchant websites.

Network File Server (NFS): a storage solution for data files.

Prediction Engine (PE): a server based system that performs data accumulation, prediction creation, and log output.

PE Cache: cache on the PE containing identifications of previously matched patterns. Contains session state for situations where the session state cannot be stored in browser cookies.

Page tags: a predefined javascript or other script variable set on a merchant's page that contains a certain string or pattern.

Referring domain: a domain (i.e., domain of website visited before the merchant's website) that a user/customer clicks through in order to reach the object of the merchant's campaign.

Report message: a package of data sent out by client-side computing device with data collected from the user's internet activities that passes through a preferred embodiment of this system, accumulating more fields in each step.

Search engine search: a mechanism (typically a campaign object used by merchants) used to track paid search queries from a particular search engine, such as MSN, AOL, Google, or Yahoo.

Serial: a merchant identifier allowing the system to identify the customer.

Series campaign: Campaigns that track a filter as well as a variable or URL parameter value.

Site link tracking: tracking when users move among internal links within merchant's website; a type of marketing campaign.

Small script: A JavaScript downloaded to the client computer for use in a tracking session. The small initially downloaded script that is designed to work in many systems or browsers. The small script subsequently enables downloading a second script identified as big script. This initial script may also be designed to collect data and send a report message to the hint servers.

Target matches: field in report message specifying what patterns were matched by the hint server.

Vis Chip: a "visit chip;" denotes previously matched patterns; part of the cookie on the client-side that is passed as a field in the report message.

Introduction

An online marketing system utilizing the features contemplated by a preferred embodiment of the invention is presented in FIG. 1. This diagram represents a preferred embodiment of a web analytics system and method providing exclusivity in campaign tracking. The system 100 might be include an end user/client computing device with internet connection and browser software 102; a merchant site hosting content and e-commerce web pages 104; a content-delivery network server 106 and an analytic system 108. This analytic system 108 may include a service console providing access to a web analytics host server, hint servers 110, prediction engines 112, a Network File Server (NFS) with site manager and log writer 114, and a database with reporting module 116. Although one database is pictured in the diagram, it will be appreciated by those skilled in the art that database management system with information distributed among several may be utilized without departing from the scope and spirit of the present invention. These exemplary components are connected through various intermediary networking devices and controls (not shown). While this diagram illustrates the components of a system for on-line marketing campaign tracking, it will be recognized by those skilled in the art that various other configurations or component substitutions are possible while still performing substantially the same functions. For instance, a third party e-commerce server may be included to host the online store, or a separate content delivery system may not be included.

The end user/client computing device 102 might be any device with internet access, such as a desktop computer, a laptop, Personal Digital Assistant (PDA), or cell phone. The web analytics system 108 plugs into the browser software on the client computing device or system 102 using a set of scripts 105, 109 downloaded from a content delivery server 106 and the web analytic system 107. The scripts create cookies that are maintained on the user's system and collect information on the user's previously visited marketing campaigns on a merchant's website, e.g., data gathered as the user views the merchant's web pages 103. Contents of the cookies are sent in a report message 304 back to the hint server 110.

The web analytic system 108 hosts a graphical user interface (GUI) that allows subscribing merchants to configure their marketing and site link tracking campaigns as they wish. This GUI, or service console, also provides analytical tools and reporting capabilities. In addition, the console hosts the reporting module which allows the merchant to view statistics for their campaigns, using standard or customized reports.

Referring again to FIG. 1, the analytic system 108 represents the neurocenter of the process. An exemplary system of a preferred embodiment uses a cluster of identical containers, each of which handles part of the traffic, for all merchants. A load balancer 107 distributes traffic to the hint servers. The hint server 110 preferably identifies the merchant owning a given incoming report message, dispatches report messages to the correct prediction engine 112, performs synchronous communication with the client 102, distributes state management instructions for segments, campaigns, and conversions, as well as caches and retrieves predictions.

The prediction engine's (PE) 112 role is to maintain global statistics on data such as conversions and top selling products; maintain per-page statistics (e.g. path analysis); provide real time statistics for reporting, maintain unified web logs and build predictions. An exemplary PE 112 may be an array of very large stand-alone processes. Each PE may handle all of the traffic for a given set of merchants. The PE writes predictions over the file system and notifies hint servers via multicast, and periodically writes global statistics to the database.

General Operation

In the current state of the art, when a merchant creates a set of marketing or site link tracking campaigns, and a particular end-user's session qualifies for more than one of them (e.g. user visits a page that matches the landing pages of two different campaigns), the session plus any transaction data such as orders are counted towards all of the matching campaigns. This situation is less than ideal for a merchant, because the totals for transaction data such as orders and revenue of all the campaigns will appear to be over-counted (i.e., some orders may be counted twice). One feature of the preferred embodiment of the present invention addresses this over-counting by allowing marketing campaigns or site link tracking campaigns to be exclusive: As will be described in more detail below, transaction data such as orders and revenue will be counted towards at most one campaign. In an embodiment such as this, sessions are counted towards all matching campaigns.

The web analytics system 108 uses a patch or piece of software code operating on the merchant website 104 to load scripts 103 that collect information and keep state about the end-user. This information is transmitted in a report message 304 from cookies placed on the end-user/client's system 102 to the web analytics hint servers 110. It will be appreciated by those skilled in the art that alternatively this information could be transmitted directly between the merchant website 104 and hint server 110 rather than utilizing a communication link through the end-user/client's system 102. A session cookie is used for storage of state between page views within a session, and a persistent cookie is used for keeping "user" state between visits to a merchants website. The client-side (e.g., client 102) generates a session ID on entry to a site such as website 104. The client-side collects and stores page attributes, such as URL, referrer and title, and computes page timing statistics, such as display time, read time, and connection type (depending on the browser used). Additional functionality on the client side includes computation of session-level attributes, gathering end-user system information, collecting e-commerce actions, gathering custom data from cookies or URL parameters, performing form tracking and storing campaign matches.

Figures 3, 4:
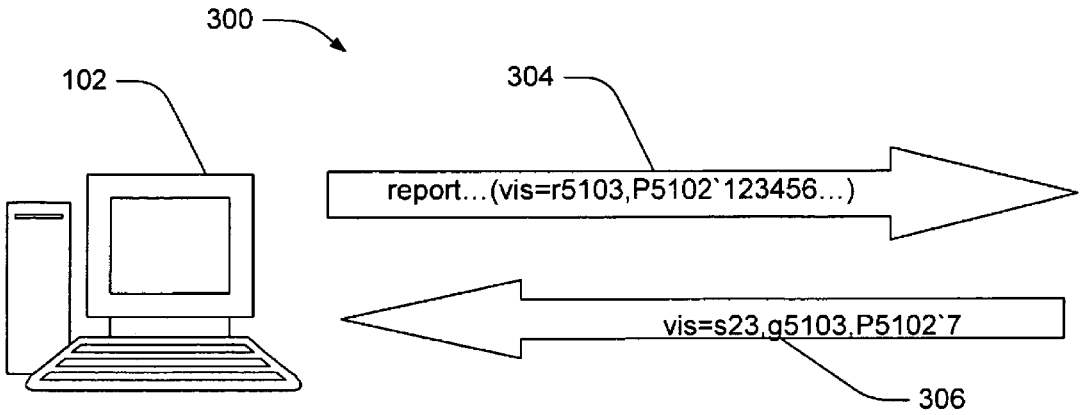
FIG. 3 is diagram of exemplary report messages sent and received by an end-user/client's system.
FIG. 4 is an exemplary report message structure for the elements added by a preferred embodiment hint server.

The information gleaned from the client side is contained in a report message 304 that is sent from the client side to the analytic system at point 107 in FIG. 1. The report message is received and processed by the hint server 110. An example of a client portion of a report message structure 200 containing a vis chip 202 that might be used in a preferred embodiment of this invention is displayed in FIG. 2. Referring to FIG. 3, the original message is an indexed string of data sent from the client system 102. The report message originally supplied by the client system 102 contains a list of all campaigns visited 304. In this example 300, the values consist of a prefix to identify the type of campaign, type of filter, and a campaign ID. In a preferred embodiment of such a system, all direct campaigns should be listed in order of qualification in the vis chip 202. This simply means storing the tags in the session cookie in the order they are added, and for repeat qualifications of the same campaign, moving the tag to the end of the vis chip 202. For example, if an end-user visits the landing page g1, the vis chip 202 is reported as "g1"; if he then visits the landing page g2, the vis chip 202 is reported as "g1, g2"; finally, if he then returns to g1, the vis chip 202 is reported as "g2, g1" since g1 is the most recent landing page visited.

As the report message 304 passes through the hint server 110, the hint server 110 appends additional fields to the report message 400, 304 (shown in FIG. 4) and passes the amended report message to the PE 112. A set of instructions is sent back to the client 102 to set cookies to certain as message/hint 306. For deferred campaigns, the chip is passed back to the client 102 as a persistent cookie (for further data collection) and a report with the same information is transmitted to the PE 112. The PE 112 will add its own set of values 500 as shown in FIG. 5 after processing, and the entire message is archived in a log file in the NFS 113, 114. An exemplary final message is shown in Table 1 below.

TABLE 1

!1162411200900'3/u/}1}http://www.hotels.com/promotion.jsp?id=1105}http://www.hotels.com/promotion.jsp?id=3548}}C1850307181R3}11}tSan Francisco, CA hotels - Hotel Reservations & Discounts for Luxury and Budget }1}15}}}}}}}}}}}2}}}}}}vis=m53z0#m55z0#m42z0#m52z1#m53z1#m54z1#m51z2#137#m41z1#m54z2#m36z1#m56z2#m55z2#m40z1#l52#l17#l31#m42z1#e125482z-#m11z1#m36z0#g440958#m52z2#m53z2#m35z0#g435236#g405989#m11z0#m40z0#g440959#g405992#g409590#115}true}}}16}1024×768}32}1}}1}8'Mozilla/4.0 (compatible; MSIE 6.0; Windows NT 5.1; SV1; .NET CLR 1.1.4322) }198.189.184.127}hotelsfbmn}115}http://www.hotels.com/promotion.jsp?id=1105}false'}}701,704,128,239,5852}405989,405992,435236,409590,125482}0}3}5}}}}}}

At the hint server 110, match referring URLs, landing URLs and page tags to campaign filters and set matches in target matches. Each matched filter results in a "chip" that is part of a report message returned to the web analytic system 108 by the client 102. PE 112 examines target matches and data in the vis chip 202 to determine whether metrics need to be incremented or whether the target had been visited previously in this session.

The client 102 does not need to distinguish between direct campaigns and deferred campaigns. This is sufficient data for the server 110 to infer which deferred campaign was visited most recently. Deferred campaigns are reported in the vis chip 202 in the format <tag>'<expires>; for example, "G5023'1059501600000", meaning the landing page for deferred campaign 5023 with landing page filter expires at time 1059501600000. If there is more than one filter in a campaign, would have chips for both filters. If you don't, the PE won't find it a full match and counters for 5023 will not be incremented. By looking up the expiration time of the deferred campaign in its CampaignConfig entry, the most recent time the deferred campaign qualified can be inferred. More precisely, a CampaignConfig entry actually stores how many days may pass between direct match and a subsequent visit to count as a deferred match.

For example, if the vis chip tag says that campaign 5023 expires in 3 days for that user, and the campaign itself has an expiration time of 7 days, it can infer that the last time the user qualified for the deferred campaign was 4 days ago.

A PE 112 is the workhorse of the web analytics system. The PE 112 in the preferred embodiment is a standalone Java application, the objectives of which are to aggregate data to produce history, analyze data to produce predictions, and format data to produce logs. Data is received from the hint server 110, where raw report messages have been matched against campaign information and amended with additional fields before being passed. The data is processed and stored in the accumulator, a report class in the PE 112 that contains data prepared for output to the merchant, which will be written to the reporting database 115, 116.

Figure 6:
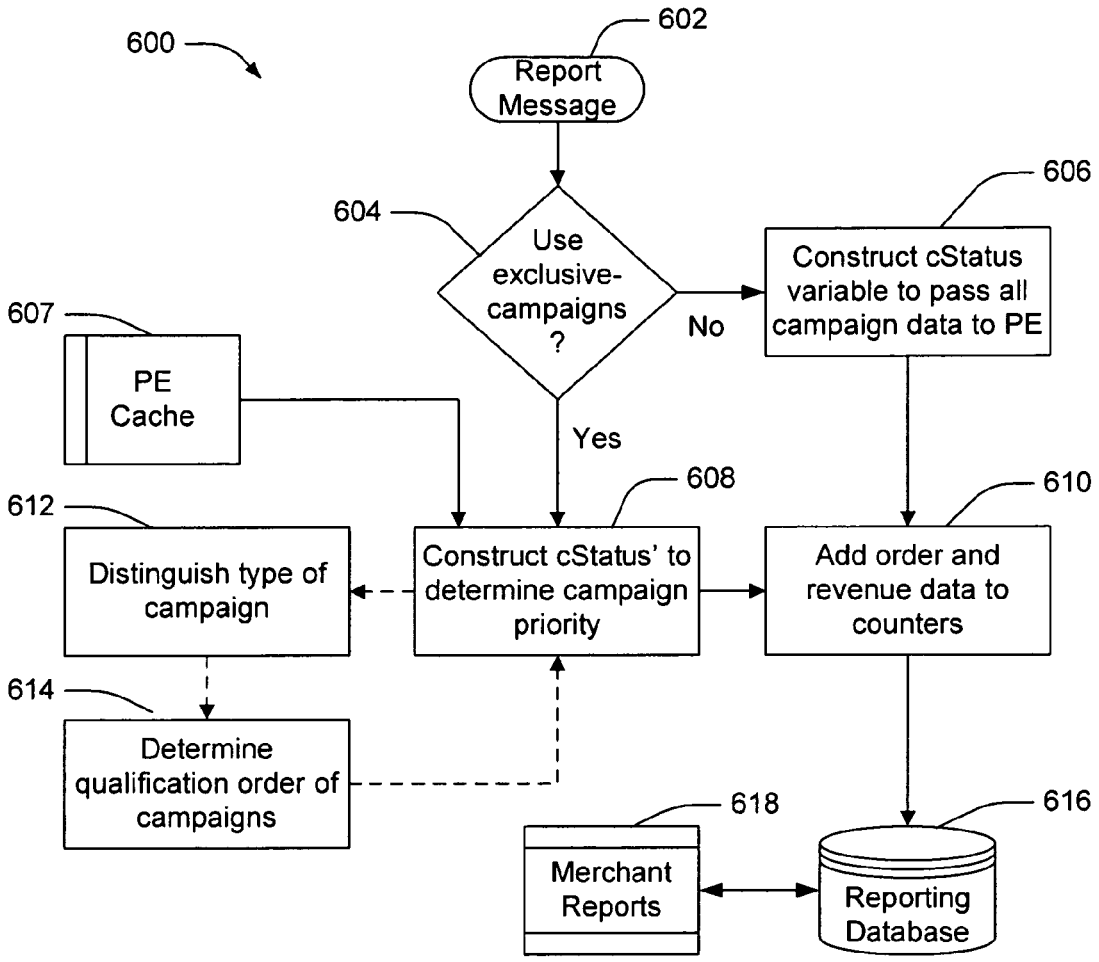
FIG. 6 is a process flow diagram illustrating preferred embodiment steps taken by a software solution to determine campaign priority in accordance with one embodiment of the invention.

FIG. 6 is a flow diagram 600 illustrating the algorithm used to determine and report the campaign data. When the accumulator processes a report message 602 with an order page tag, it adds order/revenue data to the total orders and total revenue counters 610 using a variable cStatus 606. The variable cStatus is a string containing the comma-separated list of indices of campaigns and segments for which the order qualifies (i.e., the matches found so far in the session). The counters also store the order/revenue data for campaigns 610.

When the configuration parameter "exclusive-campaigns" is true 604, the accumulator will not pass in cStatus directly to these counters, but will first determine a subset of the indices 608 that is consistent with a set of defined priority rules. These rules allow the order and revenue to be assigned to the campaign with the highest priority. In a preferred embodiment, the following rules might apply:

- Direct campaigns always have priority over deferred campaigns;
- Between two direct campaigns or two deferred campaigns, the latest visited has priority over the earlier visited;
- A campaign without a filter (landing/referrer/pre-processing rule) is considered to have been visited later than any campaign with a filter;
- If the same page of a session qualifies for multiple direct or deferred campaigns, no priority order is defined, i.e., one of the campaigns is picked;
- If an order occurs in a session that both qualifies for a marketing campaign and matches one of the referring domains/search engines, the order and revenue will only be applied to the campaign (if marketing campaigns are marked as exclusive, they are exclusive with the order/revenue information added to the referring domains and search engine reports as well);
- If a session belongs to both a regular campaign and a site link tracking campaign, the orders and revenue should be added to both;
- Within site link tracking campaigns, the same rules as marketing campaigns apply;
- Site link tracking is never exclusive with Referring Domains and Search engines;
- Natural search campaigns only get credit for orders if and only if there are no other direct or deferred campaigns that matched at the same time.

Essentially, the functionality should analyze the cStatus list and remove indices for direct campaigns that qualified before other direct campaigns according to cStatus, and remove indices for deferred campaigns that qualified before other deferred campaigns or direct campaigns. By passing in this revised cStatus, orders and revenue will be exclusive.

To construct cStatus' 608 (the cStatus string with exclusivity applied) an algorithm considers each index found in cStatus; each one should map to an active campaign or segment. Then the following rules are applied 612, 614:

- The exclusivity algorithm looks at three configuration parameters: internal search exclusivity, marketing campaign exclusivity and site link tracking exclusivity. The rules listed above are applied to the sequence of recently visited campaigns using the following algorithm:
- If internal search exclusivity 604 is enabled, then order and revenue will be assigned to the last keyword. If internal search exclusivity is disabled, order and revenue are assigned to all internal search keywords;
- If site link tracking exclusivity 604 is enabled, and there are site link tracking campaigns without filters, the order and revenue is assigned to those campaigns. Otherwise, order and revenue will be assigned to the last qualified campaign (as described above, direct takes precedence over deferred).
- If marketing campaign exclusivity 604 is enabled, and there are marketing campaigns without filters, the order and revenue are assigned to those campaigns. If not, the order and revenue are assigned to the last qualified campaign.
- If a session belongs to both a regular campaign and a site link tracking campaign, the orders/revenue may be added to both.

The "PE cache" is essentially a server-side cache of vis information kept by the PE 112 for those sessions where the client 102 is unable to set the vis chip 202 (e.g. for incomplete-download reports and reports from reduced-support browsers). An entry is added to the PE cache if the report kind indicates that the client will not be able to set the vis chip 202. The entry consists of the matches in a TARGET_MATCHES field. The cache entry's format is identical to the vis chip 202.

The PE cache 607 stores the visited tags in qualification order. That is, when multiple pages of a session add to the same PE cache entry, later qualifications should appear later in the string.

In this preferred embodiment, it is not desirable to maintain most-recent ordering information between the PE cache and the vis chip 202. However, the primary case where a session has data from both the vis chip 202 and the PE cache is when one of the first pages of a session is an incomplete download. So the heuristic it will use is that PE cache information is considered older (qualified earlier) than vis chip 202 information.

The analytics system 108 stores the data 616 and provides the merchant with detailed descriptive reports 618, 700 that enable them to understand the processes that bring a user to make a purchase on their site, i.e. which campaigns are the most successful. FIG. 7 is a screen shot of a marketing campaign report displaying, among other things, page views 702, sessions 704, orders 706, and revenue 708, for various product segments 710.

In addition to storing the results of the accumulator which identify the most successful campaigns, more granular data may be stored in a data warehouse 116, 616. A warehouse platform could use the results of the exclusivity algorithm to determine which campaign to assign each order to. Each report message produced by a PE 112 and consumed by a warehouse platform would contain at most one marketing campaign, one site link tracking campaign, and one internal search campaign (when each of the corresponding exclusivities are enabled) in dedicated report message fields. This more granular data allows creation of reports that for example would allow a merchant to view the path traversed by the user in the process of reaching the campaign and making a purchase.

Likelihood of Purchase

In this feature, merchants can track on a per-link basis the "likelihood of purchase," which is calculated by dividing the non-exclusive number of orders by the non-exclusive sessions. This will require keeping an extra "bucket" of information in site link tracking (i.e., non-exclusive orders in addition to the current exclusive orders).

One way to do this in the accumulator would be to define another counter that is identical to the ORDER_HOUR counter, except that it is passed cStatus instead of cStatus'. The campaign array for that counter may be used to determine likelihood of purchase.

Limits and Boundaries

When a page of a session qualifies for multiple campaigns, the "latest" one among that set should be considered non-deterministic. The qualification order between data in the vis chip 202 and the PE cache is a heuristic.

It is to be understood that even though numerous characteristics and advantages of various embodiments of the present invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. For example, the particular elements may vary depending on the particular application for the web interface such that different dialog boxes are presented to a user that are organized or designed differently while maintaining substantially the same functionality without departing from the scope and spirit of the present invention.

What is claimed is:

1. A method performed by a server for gathering information through a network from a client computing device about an internet marketing campaign, the method comprising:

receiving a tracking information message at the server from the client computing device, the message including transaction data and internet activity data attribute values related to a web site visit qualifying for a first and a second marketing campaign;

determining priority between the first and second marketing campaigns consistent with a set of defined priority rules establishing which types of campaigns have priority over other campaign types;

assigning the transaction data and internet activity attribute values in the tracking information message to one of the first and second marketing campaigns based on the determined priority;

updating a campaign counter for the determined priority campaign in a reporting database stored on the server with the assigned transaction data, whereby the campaign counter stores revenue and order data for the campaign; and generating a report on the server based on the campaign counter so that one and only one campaign in the report receives credit for a particular transaction when more than one marketing campaign could relate to the transaction.

2. The method of claim 1 further comprising a step of generating the tracking information message by utilizing a client-side script at the client computing device.

3. The method of claim 1 further comprising a step of generating the tracking information message by utilizing a server-side merchant system to generate the tracking information message based on activities associated with the client computing device.

4. The method of claim 1 wherein the receiving step comprises receiving the tracking information message including transaction data comprising one of: order data and revenue data.

5. The method of claim 1 wherein the receiving step comprises receiving the tracking information message comprising data associated with the first and the second marketing campaign of a particular type, the particular type being one of: each a direct campaign, a deferred campaign, a site link tracking campaign, and a deferred site link tracking campaign.

6. The method of claim 1 wherein the receiving step comprises receiving the tracking information message including data associated with end user behavior on the web site.

7. The method of claim 1 wherein the determining step comprises performing an algorithm to create indices consistent with a set of defined priority rules having priority assignments for the first and second marketing campaigns.

8. The method of claim 7 wherein the defined priority rules utilized in the determining step comprise direct campaigns having higher priority over deferred campaigns.

9. The method of claim 7 wherein the defined priority rules utilized in the determining step comprise latest visited campaigns having higher priority over earlier visited campaigns.

10. The method of claim 7 wherein the algorithm performed in the determining step comprises evaluating configuration parameters comprising internal search exclusivity, marketing campaign exclusivity and site link tracking exclusivity.

11. The method of claim 1 further comprising retrieving previous visit data from a cache and associating the previous visit data with the received tracking information message when the received information message includes transaction data but incomplete data related to the web site visit.

12. The method of claim 1 further comprising a step of returning a message to the client computing device containing information regarding deferred marketing campaigns that may be subsequently utilized to determine priority between the first and second marketing campaigns.

13. An internet marketing campaign tracking system having a server with a processor and a memory which is operatively configured for use on a network, comprising:

an analytic system operatively coupled to a client computing device through the network, the analytic system comprising program code stored in the server memory that when executed by the processor causes the server to perform operations of:

receiving a tracking information message, the message including transaction data and internet activity data related to a web site visit qualifying for at least a first and a second marketing campaign, and updating a campaign counter for an internet marketing campaign in a reporting database with the assigned transaction data associated with one of the first and second marketing campaigns based on a determined priority between the first and second marketing campaigns; and a report generator module comprising program code stored in the server memory that when executed by the processor causes the server to perform operations of generating a report based on data stored in the reporting database including the campaign counter so that one and only one campaign in the report receives credit for a particular transaction when more than one marketing campaign could relate to the transaction.

14. The internet marketing campaign tracking system of claim 13 wherein the client computing device comprises a client-side script which generates the tracking information message.

15. The internet marketing campaign tracking system of claim 13 further comprising a merchant system, the merchant system comprises a server-side module which generates the tracking information message based on activities associated with the client computing device.

16. The internet marketing campaign tracking system of claim 13 wherein the transaction data comprises one of: order data and revenue data.

17. The internet marketing campaign tracking system of claim 13 wherein the tracking information message comprises data associated with the first and the second marketing campaign of a particular type, the particular type being one of: each a direct campaign, a deferred campaign, a site link tracking campaign, and a deferred site link tracking campaign.

18. The internet marketing campaign tracking system of claim 13 wherein the tracking information message comprises data associated with end user behavior on the web site.

19. The internet marketing campaign tracking system of claim 13 wherein the analytic system further comprises program code stored in the server memory that when executed by the processor causes the server to perform an algorithm to create indices consistent with a set of defined priority rules having priority assignments for the first and second marketing campaigns.

20. The internet marketing campaign tracking system of claim 19 wherein the defined priority rules comprise direct campaigns having higher priority over deferred campaigns.

21. The internet marketing campaign tracking system of claim 19 wherein the defined priority rules comprise latest visited campaigns having higher priority over earlier visited campaigns.

22. The internet marketing campaign tracking system of claim 19 wherein the algorithm performed comprises evaluating configuration parameters comprising internal search exclusivity, marketing campaign exclusivity and site link tracking exclusivity.

23. The internet marketing campaign tracking system of claim 13 wherein the analytic system further comprises program code stored in the server memory that when executed by the processor causes the server to perform operations of retrieving previous visit data from a cache and to associate the previous visit data with the received tracking information message when the received information message includes transaction data but incomplete data related to the web site visit.

24. The internet marketing campaign tracking system of claim 13 wherein the analytic system further comprises program code stored in the server memory that when executed by the processor causes the server to perform operations of returning a message to the client computing device containing information regarding deferred marketing campaigns that may be subsequently utilized to determine priority between the first and second marketing campaigns.

* * * * *